US006091923A

United States Patent [19]

Yamamuro

[11] Patent Number: 6,091,923

[45] Date of Patent: Jul. 18, 2000

[54] FIXING DEVICE WITH WAX AND RELEASE AGENTS

[75] Inventor: Takashi Yamamuro, Ebina, Japan

[73] Assignee: Fuji Xerox Cop., Ltd., Tokyo, Japan

[21] Appl. No.: 09/320,845

[22] Filed: May 26, 1999

[30] Foreign Application Priority Data

Jul. 22, 1998 [JP] Japan ..... 10-206822

[51] Int. Cl.[7] ..... G03G 15/20

[52] U.S. Cl. ..... 399/324; 118/60; 118/DIG. 1; 399/325; 399/326

[58] Field of Search ..... 399/324–327; 118/60, DIG. 1

[56] References Cited

U.S. PATENT DOCUMENTS

| | | | |
|---|---|---|---|
| 3,934,547 | 1/1976 | Jelfo et al. | 118/60 |
| 4,034,706 | 7/1977 | Moser | 118/60 |
| 4,132,882 | 1/1979 | Endo et al. | 118/60 X |
| 5,392,105 | 2/1995 | Moser | 118/60 X |
| 5,563,695 | 10/1996 | Sakurai et al. | 118/60 X |
| 5,802,440 | 9/1998 | Maeyama | 399/327 |
| 5,880,244 | 3/1999 | Dowlen et al. | 399/111 X |

FOREIGN PATENT DOCUMENTS

| | | |
|---|---|---|
| 3-267979 | 11/1991 | Japan . |
| 4-168466 | 6/1992 | Japan . |
| 5-181384 | 7/1993 | Japan . |
| 8-123235 | 5/1996 | Japan . |
| 9-9681 | 1/1997 | Japan . |
| 9-90737 | 4/1997 | Japan . |

*Primary Examiner*—William J. Royer
*Attorney, Agent, or Firm*—Oliff & Berridge, PLC.

[57] ABSTRACT

There is provided a fixing device of an image forming apparatus in which a high quality image can be obtained through a small amount of release agent and toner offset can be prevented for a long period of time without fail. The fixing device includes a pair of fixing rotating bodies being brought into press contact with each other and being rotated, and a release agent application unit for applying a release agent onto a surface of the fixing rotating body, and makes a toner image formed on a recording material by an electrophotographic process pass through a press contact portion of the pair of fixing rotating bodies so that the toner image is fixed. The fixing device further includes a wax agent application unit for applying a wax agent onto the surface of the fixing rotating body.

13 Claims, 7 Drawing Sheets

FIXING DEVICE WITH WAX AND RELEASE AGENTS

BACKGROUND OF THE INVENTION

1. Field of the Invention

The present invention relates to an electrophotographic image forming apparatus, such as a copying machine, a printer, and a facsimile machine, and more particularly to an improvement of its fixing device.

2. Description of the Related Art

As a fixing device of an electrophotographic image forming apparatus such as a copying machine or a printer, there is hitherto well known a fixing device for carrying out fixing by a pair of roll-shaped or endless belt-shaped fixing rotating bodies which are brought into press contact with each other. That is, an unfixed toner image formed on a recording material by an electrophotographic process is made to pass through a nip portion of the pair of fixing rotating bodies, so that the toner image on the recording material is fixed on the recording material by heat and pressure from the fixing rotating bodies at that time, and a permanent image is obtained.

In such a fixing device, an unfixed toner is put in a melted state when passing through the nip portion of the pair of fixing rotating bodies, so that the toner is apt to adhere to the fixing rotating body with which the toner comes in contact. Thus, there have been problems that the recording material itself is not separated from the fixing rotating body to cause a jam, the toner adhered to the fixing rotating body stains a subsequent recording material, and so on. Accordingly, such a method has been generally adopted that a release agent such as silicone oil is applied to the surface of the fixing rotating body to improve a release property between the toner and the fixing rotating body.

Here, in order to make separation without fail, it is necessary that the release agent is uniformly applied to the surface of the fixing rotating body. On the other hand, if the release agent is excessively applied, there occur problems of poor image quality, especially poor reproducibility of color of a full color image, poor light transparency of an OHP sheet, and the like. Then, for the purpose of uniformly applying the smallest possible amount of release agent to the surface of the fixing rotating body for a long period of time, various proposals have been hitherto made.

For example, Japanese Patent Unexamined Publication No. Hei. 3-267979 discloses a technique for impregnating a cleaning web of a fixing rotating body with a release agent, Japanese Patent Unexamined Publication No. Hei. 8-123235 discloses a technique of using a mixture of release agents with different coefficients of viscosity, Japanese Patent Unexamined Publication No. Hei. 9-9681, No. Hei. 9-90737, and No. Hei. 5-181384 disclose a technique of doping an outermost surface layer of a fixing rotating body with a release agent directly or with a capsuled release agent, and Japanese Patent Unexamined Publication No. Hei. 4-168466 discloses a technique of using wax as a release agent.

However, higher quality has been required for an electrophotographic image, and it can not be necessarily said that offset can be prevented without fail and a sufficiently high quality image can be secured by these techniques. Particularly, in the case where a fixing rotating body deteriorated by use with a lapse of time or the like is used, there is a fear that if the amount of the release agent is small, the offset occurs immediately, so that it becomes necessary to replace the fixing rotating body.

SUMMARY OF THE INVENTION

The present invention has been made in view of the above problems, and an object of the invention is to provide a fixing device of an image forming apparatus which can obtain a high quality image through a small amount of release agent and can prevent toner offset for a long period of time without fail.

According to an aspect of the present invention, a fixing device of an image forming apparatus comprises a pair of fixing rotating bodies being brought into press contact with each other and being rotated, and release agent application means for applying a release agent onto a surface of the fixing rotating body, and makes a toner image formed on a recording material by an electrophotographic process pass through a press contact portion of the pair of fixing rotating bodies so that the toner image is fixed, wherein the fixing device further comprises wax agent application means for applying a wax agent onto the surface of the fixing rotating body.

Here, the wax agent application means may apply the wax agent onto the surface of the fixing rotating body which comes in contact with the toner image. Besides, the fixing device of the image forming apparatus may comprise cleaning means which comes in press contact with the fixing rotating body coming in contact with the toner image and cleans its surface, and the wax agent application means may be provided at a downstream side of a cleaning position and an upstream side of a release agent application position in a rotating direction of the fixing rotating body. Moreover, the fixing device of the image forming apparatus may comprise cleaning means which comes in press contact with the fixing rotating body coming in contact with the toner image and cleans its surface, and the cleaning means may apply the wax agent while cleaning the surface of the fixing rotating body. Moreover, in the case where the cleaning means includes a web member, and the surface of the fixing rotating body is cleaned by making the web member brought into press contact with the fixing rotating body with which the toner image comes in contact, the web member may hold the wax agent.

Moreover, according to another aspect of the present invention, a fixing device of an image forming apparatus comprises a pair of fixing rotating bodies being brought into press contact with each other and being rotated, and release agent application means for applying a release agent onto a surface of the fixing rotating body, and makes a toner image formed on a recording material by an electrophotographic process pass through a press contact portion of the pair of fixing rotating bodies so that the toner image is fixed, wherein a wax agent is held at the fixing rotating body with which the toner image comes in contact.

Moreover, according to a still another aspect of the present invention, a fixing device of an image forming apparatus comprises a pair of fixing rotating bodies being brought into press contact with each other and being rotated, and release agent application means for applying a release agent onto a surface of the fixing rotating body, and makes a toner image formed on a recording material by an electrophotographic process pass through a press contact portion of the pair of fixing rotating bodies so that the toner image is fixed, wherein a wax agent is added in the release agent, and the release agent application means applies the wax agent while applying the release agent onto the surface of the fixing rotating body.

The wax agent is a wax or a mixture of a wax and an oil. The kind and the amount of the wax in the wax agent can be suitably selected and set. In the case where the wax agent is a mixture of a wax and an oil, the oil is suitably selected according to a material of the surface of the fixing rotating body with which the toner comes in contact.

DETAILED DESCRIPTION OF THE PREFERRED EMBODIMENTS

Figure 1:
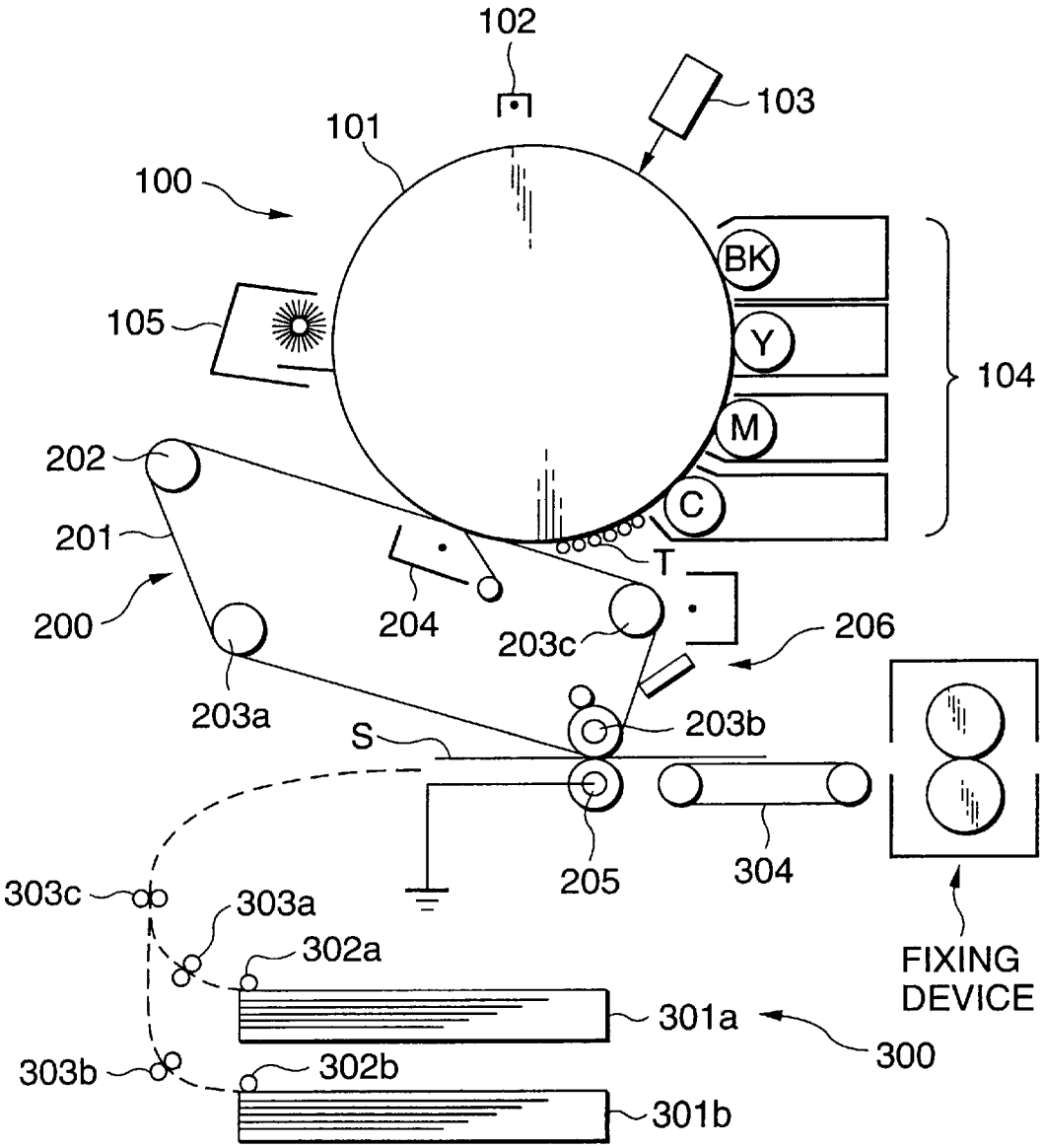
FIG. 1 is a view showing an example of an image forming apparatus to which the invention can be applied.

FIG. 1 is a view showing an example of an image forming apparatus to which the present invention can be applied, that is, the outline of a color copying machine, which is roughly constituted by an image forming portion 100, an intermediate transfer portion 200, a conveying portion 300, and a fixing device of the present invention.

The image forming portion 100 includes a photosensitive drum 101, a charging unit 102, an exposing unit 103, a developing unit 104, a photosensitive body cleaning unit 105, and the like. The developing unit 104 includes developing units Bk, 4, C and M for each color of black, yellow, cyan, and magenta. The intermediate transfer portion 200 includes an intermediate transfer belt 201, a driving roll 202, stretching rolls 203*a*, 203*b*, and 203*c*, a primary transfer unit (transfer corotron) 204, a secondary transfer unit (transfer roll) 205, a belt cleaning device 206, and the like. The conveying portion 300 includes recording material trays 301*a* and 301*b*, pickup rolls 302*a* and 302*b*, conveying roll pairs 303*a*, 303*b*, and 303*c*, a registration roll pair (not shown), a conveying belt device 304, and the like.

The operation of forming a full color image by such an image forming apparatus will be described. The surface of the photosensitive drum 101 is charged to a uniform predetermined potential by the charging unit 102. Next, the surface of the photosensitive drum 101 is irradiated with laser light from the exposing unit 103 corresponding to, for example, an image of black component, so that an electrostatic latent image due to a potential difference is formed on the surface of the photosensitive drum 101. The electrostatic latent image is developed with a toner by the black developing unit Bk, so that an explicit image of the black toner is formed. This black toner image is moved to the primary transfer position, where it comes in contact with the intermediate transfer belt 201, with the rotation of the photosensitive drum 101. At this time, the black toner is primarily transferred to the intermediate transfer belt 201 with the primary transfer unit 204 and by the action of an electric field. Incidentally, a small amount of residual black toner which has not been primarily transferred and has remained on the surface of the photosensitive drum 101, is cleaned by the downstream photosensitive body cleaning unit 105. Such an image forming process is performed for each color of yellow, magenta, and cyan.

On the other hand, the intermediate transfer belt 201 is rotated and driven in such a state that it is stretched by the driving roll 202 and the stretching rolls 203*a* to 203*c* with a predetermined tension force. With this rotation, the toner image primarily transferred on to the intermediate transfer belt 201 is also moved. At this time, until the primary transfer of the final color (for example, cyan) is ended, the transfer roll 205 of the secondary transfer unit and the belt cleaning device 206 are separated from the belt 201. Thus, when the black toner image primarily transferred to the belt 201 again reaches the primary transfer position, a next color toner image, for example, a yellow toner image is primarily transferred and is overlapped. Further, when the toner image reaches the primary transfer position, a magenta toner image and further a cyan toner image are sequentially overlapped. After the final color toner image is primarily transferred, the transfer roll 205 of the secondary transfer unit and the belt cleaning device 206 are brought into contact with the belt 201.

The recording material housed in the recording material trays 301*a* and 301*b* is moved to the vicinity of the secondary transfer position by the pickup rolls 302*a* and 302*b* and the conveying roll pairs 303*a* to 303*c*, and nipping of the registration roll pair (not shown) is released at the timing when the toner images of all colors are overlapped on the belt 201 and reach the secondary transfer position, so that the recording material is conveyed to the secondary transfer position. There, by the action of an electric field supplied from the transfer roll 205, the toner images of all colors are secondarily transferred to the recording material, so that the recording material holds the full color image on its surface. Then the recording material is conveyed to a fixing position by the conveying belt 304, and when it passes through a nip portion between a heating roll and a pressurizing roll, the full color toner image is fixed to the recording material by the action of heat and pressure to form a permanent image, so that the image formation is ended.

Figure 2:
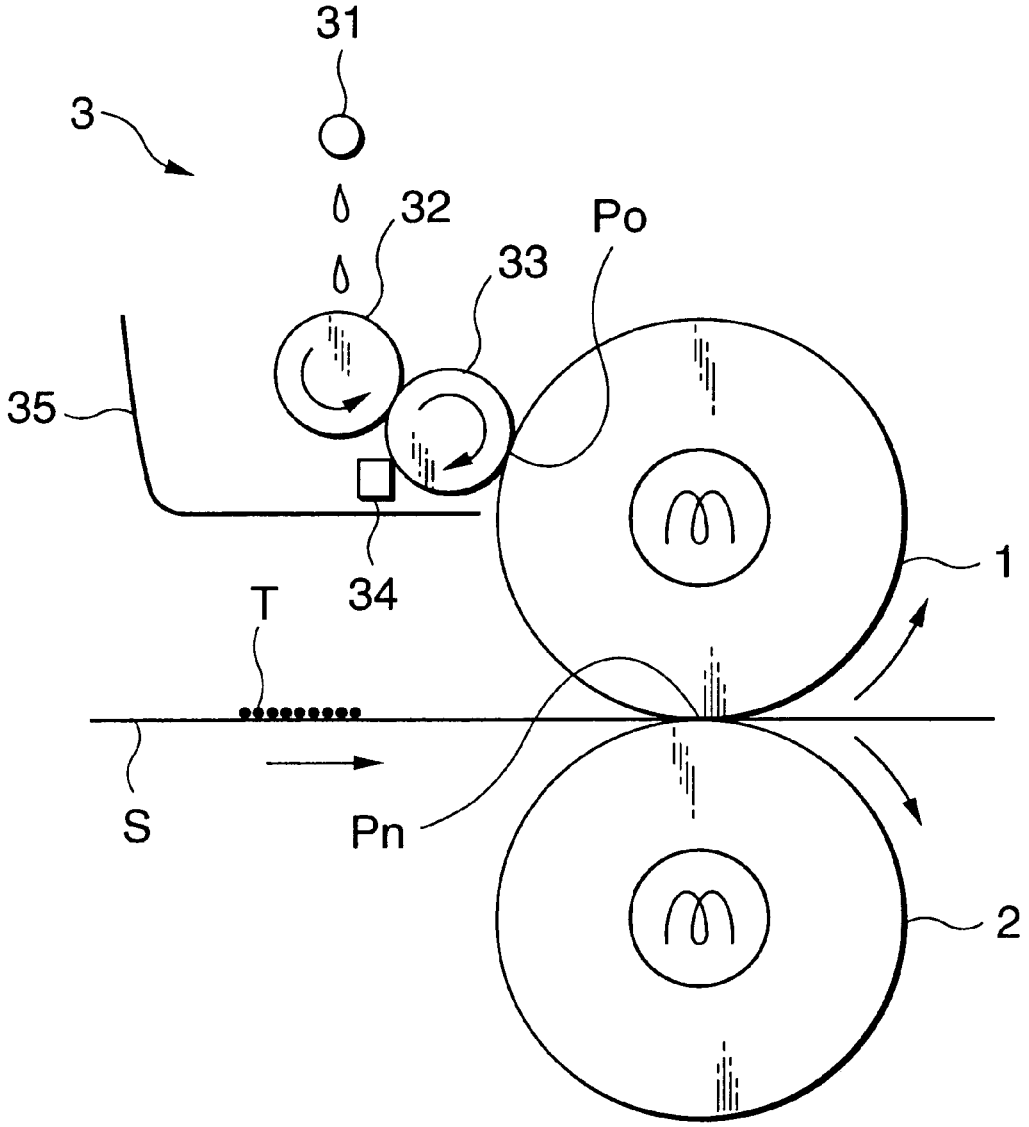
FIG. 2 is a view showing an example of a fixing device to which the invention can be applied.

FIG. 2 shows an example of a fixing device to which the present invention can be applied. This fixing device includes a pair of fixing rotating bodies 1 and 2 which are brought into press contact with each other and are rotated, and release agent application means 3 for applying a release agent to the surface of the fixing rotating body.

Here, the one fixing rotating body 1 is fixedly attached at a side on a recording material S with which an unfixed toner T comes in contact, and has a roll shape of a multilayer structure composed of, from its center, a core member made of aluminum, an inner layer made of silicone rubber, and a surface layer made of a polyimide substrate coated with fluorine resin. A halogen lamp is provided in the inside of the core member as a heat source (this fixing rotating body 1 will be hereinafter referred to as a fixing roll 1). The other fixing rotating body 2 is attached at a side on the recording material S with which the unfixed toner does not come in contact while being pressurized to be brought into press contact with the fixing roll 1. This rotating body has a roll shape of a multilayer structure composed of, from its center, a core member made of aluminum, an inner layer made of silicone rubber, and a surface layer made of PFA tube. A halogen lamp is provided in the inside of the core member as a heat source (this fixing rotating body 2 will be hereinafter referred to as a pressurizing roll 2).

The release agent application means 3 includes an oil pipe 31 from the inside of which a fresh release agent gradually oozes, a rotatable pickup roll 32 for receiving the release agent from the oil pipe 31, a donor roll 33 rotatably coming in press contact with the pickup roll 32 and the fixing roll 1 to apply the release agent from the pickup roll 32 to the fixing roll 1, an oil blade 34 for regulating the amount of the release agent applied to the donor roll 33, an oil pan 35 for holding a surplus release agent, and the like. As the release agent, dimethyl silicone oil, amine denatured oil, or mercapto oil can be used, and further, a mixture of several kinds of these may also be used.

A fixing step of an unfixed toner image by such fixing device will be described in more detail. Before the recording material S holding the unfixed toner image T on its upper portion reaches a nip portion Pn between the fixing roll 1 and the pressurizing roll 2, both the rolls are rotated, and the inside halogen lamps are heated. The donor roll 33 being in press contact with the surface of the fixing roll 1, and the pickup roll 32 being in press contact with the donor roll 33 are rotated in accordance with the rotation of the fixing roll 1. The release agent gradually supplied from the oil pipe 31 is thinly supplied to the surface of the fixing roll 1 at the nip portion Po between the fixing roll 1 and the donor roll 33.

After the temperature of the surface of the fixing roll 1 reaches a sufficient temperature to melt a toner, and a uniform thin film of the release agent is formed on the surface, the recording material S goes into the nip portion Pn. The toner image T held on the upper portion is melted by the heat and pressure from the fixing roll 1 and the pressurizing roll 2, so that the toner image is fixed as a permanent image on the recording material S. The release agent prevents the melted toner from adhering on the surface of the fixing roll 1.

The fixing device to which the present invention can be applied is not limited to this, but other structures may be adopted. For example, the fixing rotating body 2 may be made of an endless belt stretched by a plurality of stretching rolls and drive rolls. Alternatively, the outermost surface of the fixing roll 1 may be made of another material such as fluorine rubber, silicone rubber, or silicone resin. Besides, the release agent application means 3 may be made to have another structure such as a single roll impregnated with a release agent in advance.

In such a fixing device, the present invention is such that (1) wax application means 5 for applying a wax agent to the surfaces of the fixing rotating bodies 1 and 2 is included, (2) the surface of the fixing rotating body 1 with which the toner image comes in contact is coated with a wax agent, or (3) the release agent application means 3 applies a wax agent together with the release agent to the surfaces of the fixing rotating bodies 1 and 2.

When the fixing device is structured like this, and the wax agent with high affinity to both the material of the surface of the fixing rotating body 1 and the release agent, it becomes possible to stably form a thin film of the release agent on the surface of the fixing rotating body 1 for a long period of time, and it is not necessary to use a large amount of release agent. As a result, a high quality image can be obtained. It appears that this is because in a stop state of the fixing device, the wax agent and the release agent become a solid or liquid state with high viscosity so that a function to hold the release agent is obtained, and in a working state of the fixing device, that is, when the surface of the fixing rotating body 1 is heated, the wax agent and the release agent are melted so that the thin film of the release agent is formed. Moreover, the wax agent serves to repair the surface of the fixing rotating body 1 which is deteriorated by use with a lapse of time, so that it is possible to prevent toner offset for a long period of time without fail. It appears that this is because the wax agent and the release agent of a solid or with a high viscosity exist to cover the roughness of the surface of the fixing rotating body 1 which has been produced by deterioration.

The wax agent is a wax or a mixture of a wax and an oil. The wax is an organic material which is a solid at room temperature, becomes a liquid with a low viscosity when heated, and includes an ester of a fatty acid and insoluble higher monohydric alcohol class or dihydric alcohol class, grease, and the like. For example, as a natural wax, there are listed a vegetable wax such as candelilla wax, carnauba wax, sumac wax, and sugar wax, an animal wax such as beeswax, insect wax, spermacetic wax, and wool wax, a petroleum wax such as paraffin wax and microsrystalline wax, a mineral wax such as montan wax and ozokerite wax, and the like. Besides, as a synthetic wax, there are listed carbon wax, polyethylene wax, and chlorinated naphthalene wax. Further, it is possible to use a processed wax such as mixed wax, oxidized wax, hydrogenated wax, or the like of these.

In the case where the wax agent is a mixture of a wax and an oil, the oil is a liquid at room temperature, and a silicone oil, an amine denatured oil, a mercapto oil, or the like may be used. These oils to be used may have the same quality as the release agent applied by the release agent application means, or may have different qualities, and such an oil and wax are mixed with heating and stirring.

It is preferable that the melting point of the wax is 40° C. or more. This is because the wax agent and the release agent become a solid or liquid with a high viscosity at room temperature lower than 40° C., so that they do not flow down from the fixing rotating body or are not unevenly distributed. On the other hand, it is desirable that the melting point of the wax is lower than the surface temperature of the fixing rotating body under operation. For example, it is preferable that the melting point is not higher than 130° C. This is because the wax agent and the release agent are melted during the operation to supply the held release agent to the recording material, so that the occurrence of offset toner is effectively prevented for a long period of time. Further, in order to cause the offset preventing effect to be exerted immediately after the start of heating of the fixing rotating body, it is preferable that the melting point of the wax is not higher than 70° C. As the wax satisfying the condition that the melting point is 40° C. to 130° C., there are listed, for example, the foregoing paraffin wax, polyethylene wax as low molecular weight polyethylene, montan wax, carnauba wax, candelilla wax, beeswax, insect wax, etc. as a natural wax.

Among all of the release agent and the wax agent held by the fixing rotating body 1 with which the toner comes in contact, it is preferable that the amount of the wax is 0.1 wt % to 20 wt %. This is because if the amount of the wax is lower than this range, the wax agent and the release agent on the surface of the fixing rotating body 1 are melted, so that the effect of holding there lease agent is hard to become effective. Besides, if it is higher than this range, the wax agent and the release agent become a hard solid while the fixing rotating body 1 is not heated, so that there is a fear that the surfaces of the fixing rotating bodies 1 and 2 are damaged by rubbing.

In the case where the wax agent is a mixture of a wax and an oil, it is preferable to suitably select the oil in the mixture according to the material of the surface of the fixing rotating body 1 with which the toner comes in contact, and the kind of the release agent. That is, even in the case where the affinity between the surface of the fixing rotating body 1 and the release agent is relatively low and it is difficult to form the film of the release agent on the surface of the fixing rotating body 1 as thin as possible and stably, when the oil with a high affinity to the surface of the fixing rotating body 1 is mixed in the wax agent, it is possible to form the thin film of the release agent stably on the surface of the fixing rotating body 1 through the wax agent. For example, in the case where fluorine rubber is used for the surface of the fixing rotating body, and amine denatured oil is used as the release agent, that is, the materials with relatively low affinity to each other are used, it is preferable to select silicone oil as the oil in the wax agent, which has a relatively high affinity to the fluorine rubber.

Preferred embodiments of the present invention will be described in more specifically below.

Embodiment 1

A fixing device of an image forming apparatus of this embodiment is such that in a fixing device of an image forming apparatus, which includes a pair of fixing rotating bodies 1 and 2 being brought into press contact with each other and being rotated, and release agent application means 3 for applying a release agent onto the surfaces of the fixing rotating bodies 1 and 2, and in which a toner image formed on a recording material by an electrophotographic process is made to pass through a press contact portion of the pair of fixing rotating bodies 1 and 2 so that the toner image is fixed, wax agent application means 5 for applying a wax agent onto the surface of the fixing rotating body is provided.

Figure 3A:
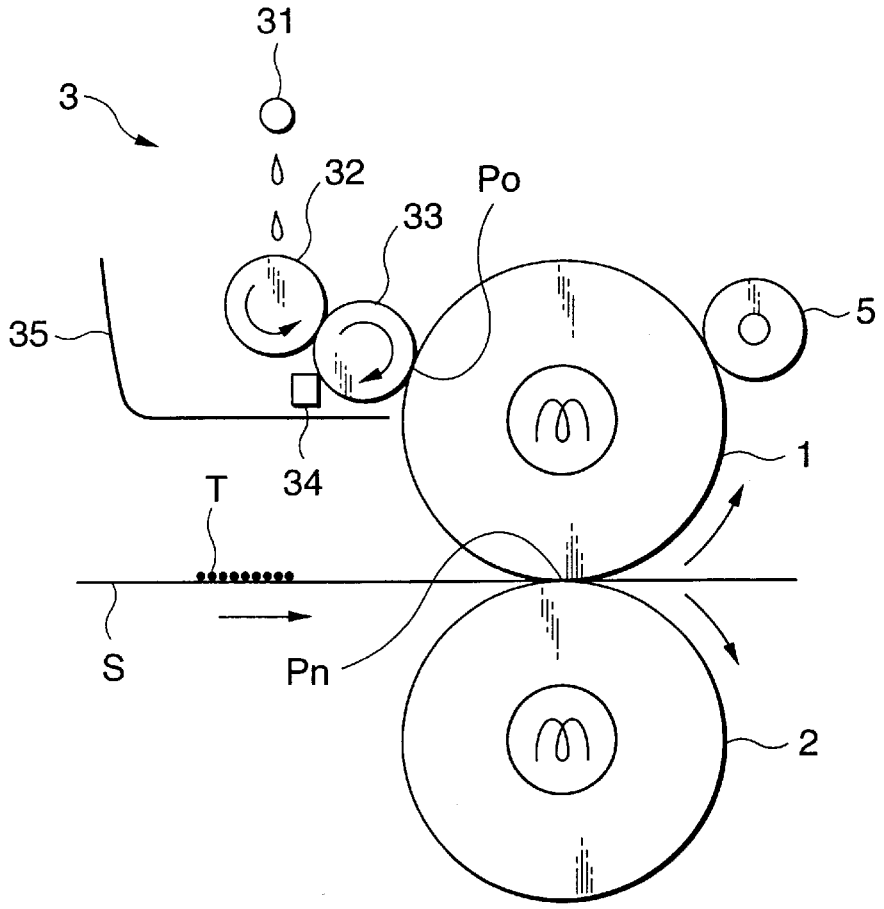
FIGS. 3(*a*) and 3(*b*) are views showing the entire of a fixing device of embodiment 1 and wax agent application means, respectively.
Figure 3B:
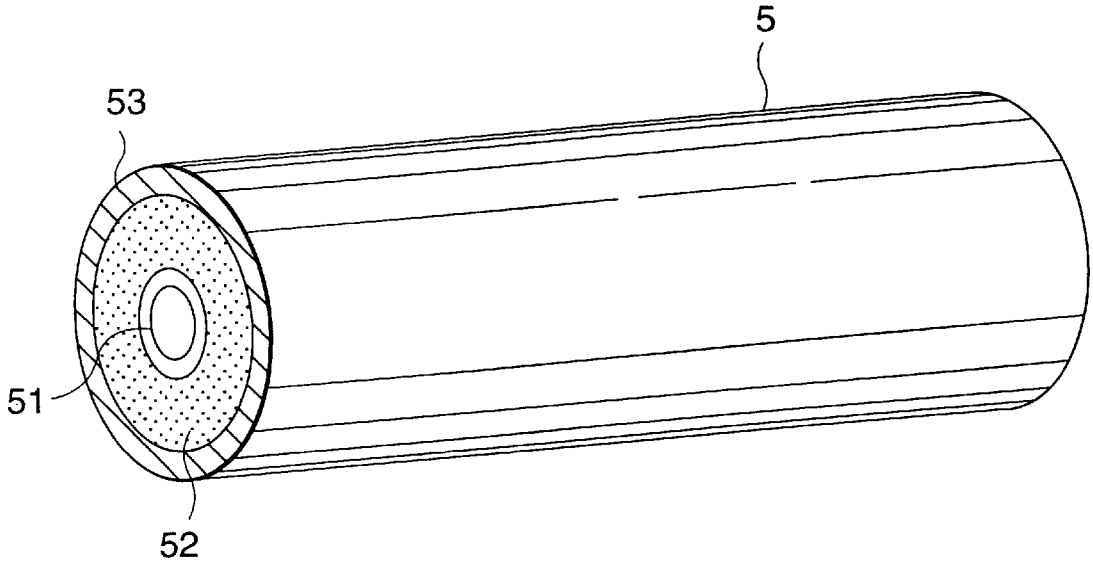

FIG. 3(*a*) shows an outline of the fixing device of this embodiment. The rotatable roll-shaped wax agent application means 5 is brought into press contact with the surface of the fixing roll 1. FIG. 3(*b*) shows the structure of the wax agent application means 5 more specifically. The wax agent application means 5 in this embodiment is made of a multilayer structure roll which includes an inner aluminum hollow shaft 51, a wax agent holding layer 52 provided on the outside diameter portion of the hollow shaft, and a wax agent regulating layer 53 provided on the outside diameter portion of the holding layer. The wax agent holding layer 52 is for holding the wax agent, and Nomexfelt (trade name, made by Nitto Co., Ltd. or Dinaox Co.) is used here. The wax agent regulating layer 53 is for regulating the amount of the wax agent supplied to the fixing roll 1 from the wax agent holding layer 52, and a Gore-Tex sheet (trade name, made of Gore-Tex Co.) is used here.

Here, as the wax agent, the wax agent holding layer 52 is made to hold such a wax agent as to contain a wax or a wax mixed with an oil, and as to have a solid or semi-solid state at room temperature less than 40° C. In this case, it is possible to hold a large amount of wax in the wax agent holding layer 52, so that an exchange cycle of the wax agent application means 5 is extended. Besides, even if the fixing device is put in a long stop state, the inside wax agent is not unevenly distributed. Incidentally, at the time of application of the wax agent, the wax agent is melted by heat of the fixing roll 1, so that the wax agent is smoothly applied to the fixing roll FIGS. 4(*a*) and 4(*b*) are explanatory views for explaining the ways of causing the wax agent to be held into the wax agent application means 5. In the method shown in FIG. 4(*a*), the roll is immersed in a container containing the wax agent, the roll is rotated after taken out from the container so that a surplus wax agent is wiped out by a blade or web, and the wax agent is held in the inside. In the method shown in FIG. 4(*b*), the wax agent is applied to the roll and is spread therein by a blade or web while the roll is rotated, so that the wax agent is held in the inside. In any case, when these operations are performed while the wax agent and the roll are suitably heated, the wax agent can be effectively held in the wax agent holding layer 52. Other than these, a heated wax agent may be filled in the wax agent holding layer 52 of the release agent application means 5 by an injector.

Although the wax agent application means 5 may be disposed to be brought into press contact with the fixing roll 1 as shown in FIG. 3, such a structure may be adopted that the wax agent application means is disposed to be brought into press contact with the pressurizing roll 2, and the wax agent is applied to the fixing roll 1 from the pressurizing roll 2 through the nip portion Pn. In the case where the wax agent application means is provided to come in press contact with the fixing roll 1, it is preferable that the wax agent application means is disposed at the upstream side of the nip portion Po in the rotation direction of the fixing roll 1 and at the downstream side of the nip portion Pn in the rotation direction. This is because the wax agent is applied before the release agent is applied to the surface of the fixing roll 1, so that fixing is performed after a thin film of the release agent is formed on the surface of the fixing roll 1 more stably by the action of the wax agent.

Figure 5:
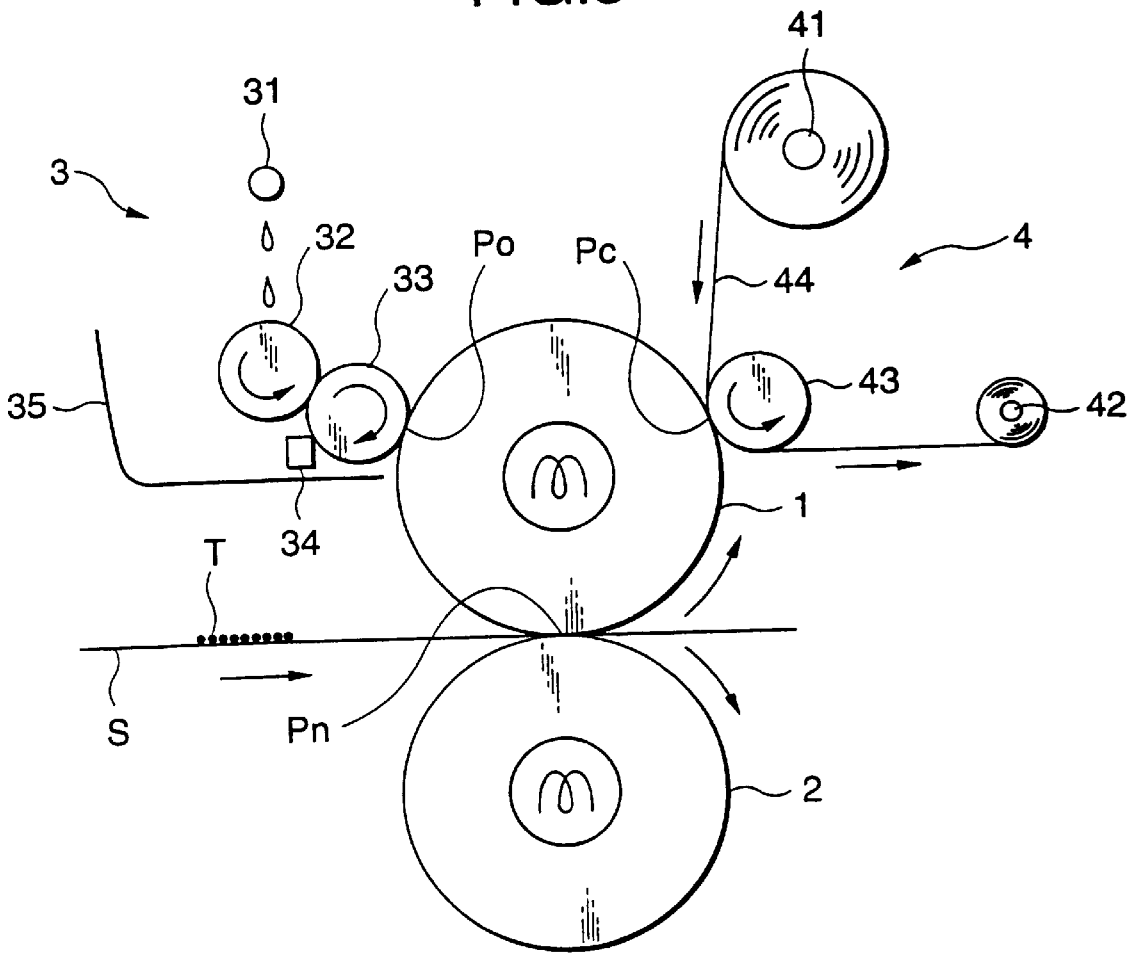
FIG. 5 is a view showing another example of a fixing device to which the invention can be applied.

Some fixing devices include, as shown in FIG. 5, cleaning means 4 for cleaning the surface of the fixing roll 1. This cleaning means 4 is, for example, as shown in FIG. 5, constituted by a web member 44 of non-woven cloth or the like made of polyamide and polyester, a press contact roll 43 for bringing the web member 44 into press contact with the surface of the fixing roll at a nip portion Pc, a feed roll 41 for feeding the web member 44, a rewinding roll 42 for rewinding the web member 44 in the direction reverse to the rotation of the fixing roll 1 by rotation driving, and the like. The cleaning means cleans offset toner, paper fiber, and the like adhered on the surface of the fixing roll 1.

In the fixing device including such cleaning means 4, it is preferable to provide the wax agent application means 5 at the upstream side of the nip portion Po in the rotation direction of the fixing roll 1 and at the downstream side of the nip portion Pc in the rotation direction. This is for preventing the wax agent applied to the surface of the fixing roll from being immediately removed by the cleaning means 4.

Figure 4A:
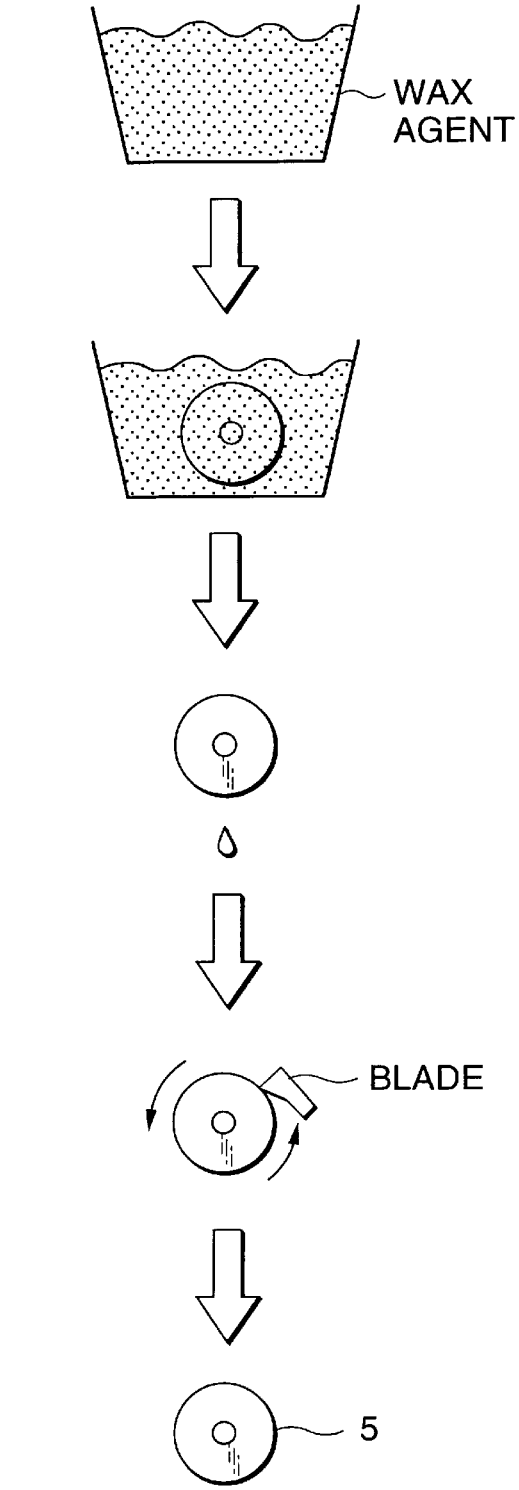
FIGS. 4(*a*) and 4(*b*) are explanatory views for explaining the ways of causing a wax agent to be held.
Figure 4B:
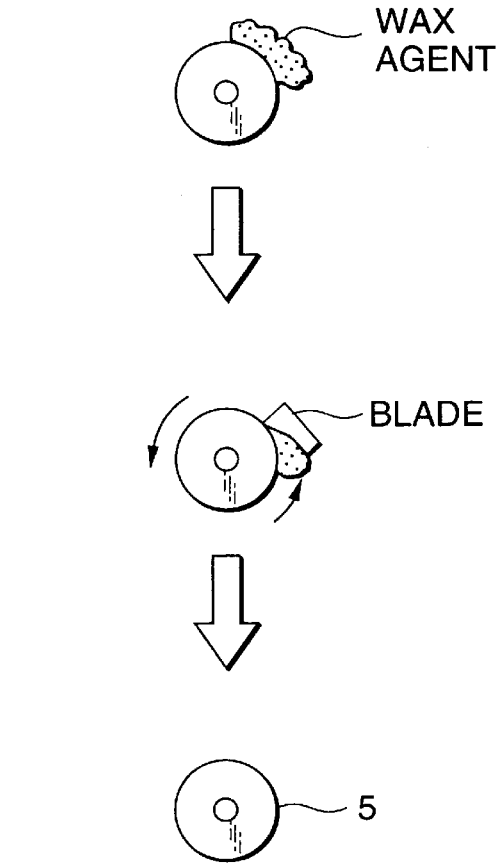
Figure 6:
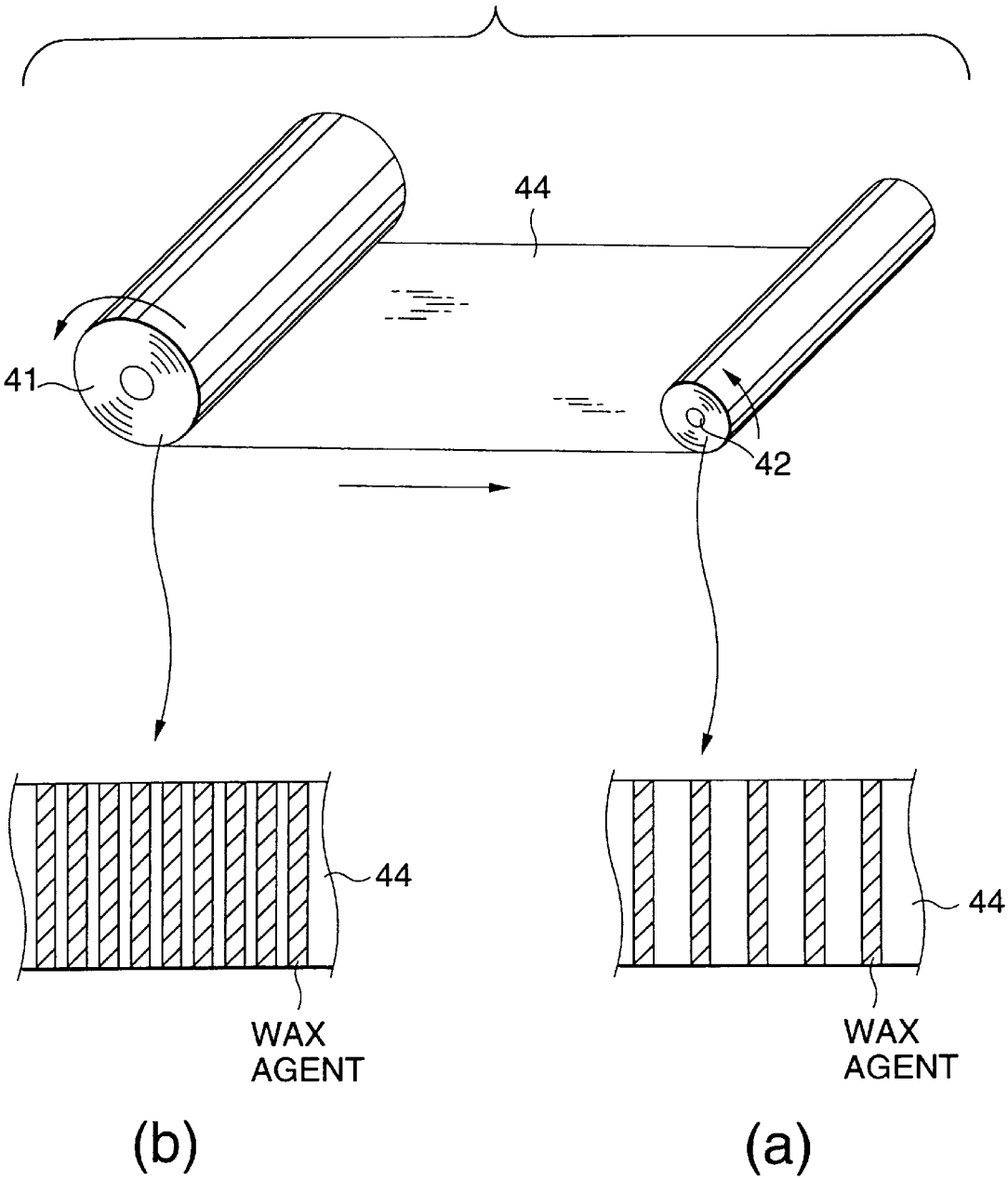
FIGS. 6(*a*) and 6(*b*) are views showing states in which a web member of a cleaning means is coated with bolt-like wax agents.

Further, the fixing device may be such that the wax agent is held on the web member 44, and the wax agent is applied to the surface of the fixing roll 1 by such cleaning means 4. In this case, as a method of causing the wax agent to be held to the web member 44, as shown in FIG. 4(*a*), the feed roll 41 on which the web member 44 is wound is immersed in the wax agent so that the wax agent can be held. It is also possible to cause the wax agent to be held on the web member by applying band-like wax agents in the axial direction of the feed roll 41 and the rewinding roll 42 at a predetermined interval in the feed direction. Further, as shown in FIGS. 6(*a*) and 6(*b*); the intervals of the band-like wax agents may be made such that an interval at the rear side of the web member 44 is narrower than that at the front side thereof. When such structure is adopted, even if the surface of the fixing roll 1 is degraded with long use, since the interval of the band-like wax agents is narrow at the rear side of the web member 44, a larger amount of wax agent is supplied. Thus, the roughness of the surface of the fixing roll 1 is effectively repaired, and the layer of the release agent can be stably formed on the surface.

Embodiment 2

A fixing device of this embodiment is such that in a fixing device of an image forming apparatus, which includes a pair of fixing rotating bodies 1 and 2 being brought into press contact with each other and being rotated, and release agent application means for applying a release agent onto the surfaces of the fixing rotating body 1, and in which a toner image formed on a recording material by an electrophotographic process is made to pass through a press contact portion of the pair of fixing rotating bodies 1 and 2 so that the toner image is fixed, a wax agent is held in the fixing rotating body 1 with which the toner image comes in contact.

That is, the wax agent is previously held in the fixing roll 1 of the fixing device as shown in FIG. 2. As methods of holding the wax agent in the fixing roll 1, a heated wax agent may be filled by an injector, or as shown in FIGS. 4(*a*) and 4(*b*), such a method may be made that the fixing roll 1 is immersed in the wax agent, or the wax agent is spread into the fixing roll.

Embodiment 3

A fixing device of this embodiment is such that in a fixing device of an image forming apparatus, which includes a pair of fixing rotating bodies 1 and 2 being brought into press contact with each other and being rotated, and release agent application means 3 for applying a release agent onto the surface of the fixing rotating body 1, and in which a toner image formed on a recording material by an electrophotographic process is made to pass through a press contact portion of the pair of fixing rotating bodies 1 and 2 so that the toner image is fixed, a wax agent is added in the release agent, so that the release agent application means 3 applies the wax agent while applying the release agent onto the surface of the fixing rotating body.

That is, the wax agent is added in the release agent applied by the release agent application means 3 as shown in FIG. 2. Here, the addition amount of the wax agent to the release agent is preferably such that an amount of wax is not higher than 1 wt % in the total of the release agent and the wax agent. This is because if the amount of the wax is excessively large, the release agent in the release agent application means 3 is solidified, and there is a fear that smooth application to the fixing roll 1 is prevented. Particularly, as in the release agent application means 3 shown in FIG. 2, in the release agent application means in which the release agent is gradually supplied through the oil pipe 31, for the purpose of preventing the inside release agent from being deteriorated by heat from the fixing roll 1, the oil pipe 31 is generally separated from the fixing roll 1 and is placed at a position where the temperature does not rise very much. Thus, the inside release agent added with the wax agent is apt to be solidified, and there is a fear that a supply hole (not shown) of the oil pipe 31 is clogged with the release agent, which is a reason for limiting the amount of the wax.

Other than this, the wax agent can also be held in advance by filling a heated wax agent into the pickup roll 32 of the release agent application means 3 and/or the donor roll 33 by an injector, or as shown in FIG. 4(*a*) or 4(*b*), the wax agent can be held by such a method as to immerse the roll in the wax agent or to spread the wax agent into the roll.

Test Results

Figure 7:
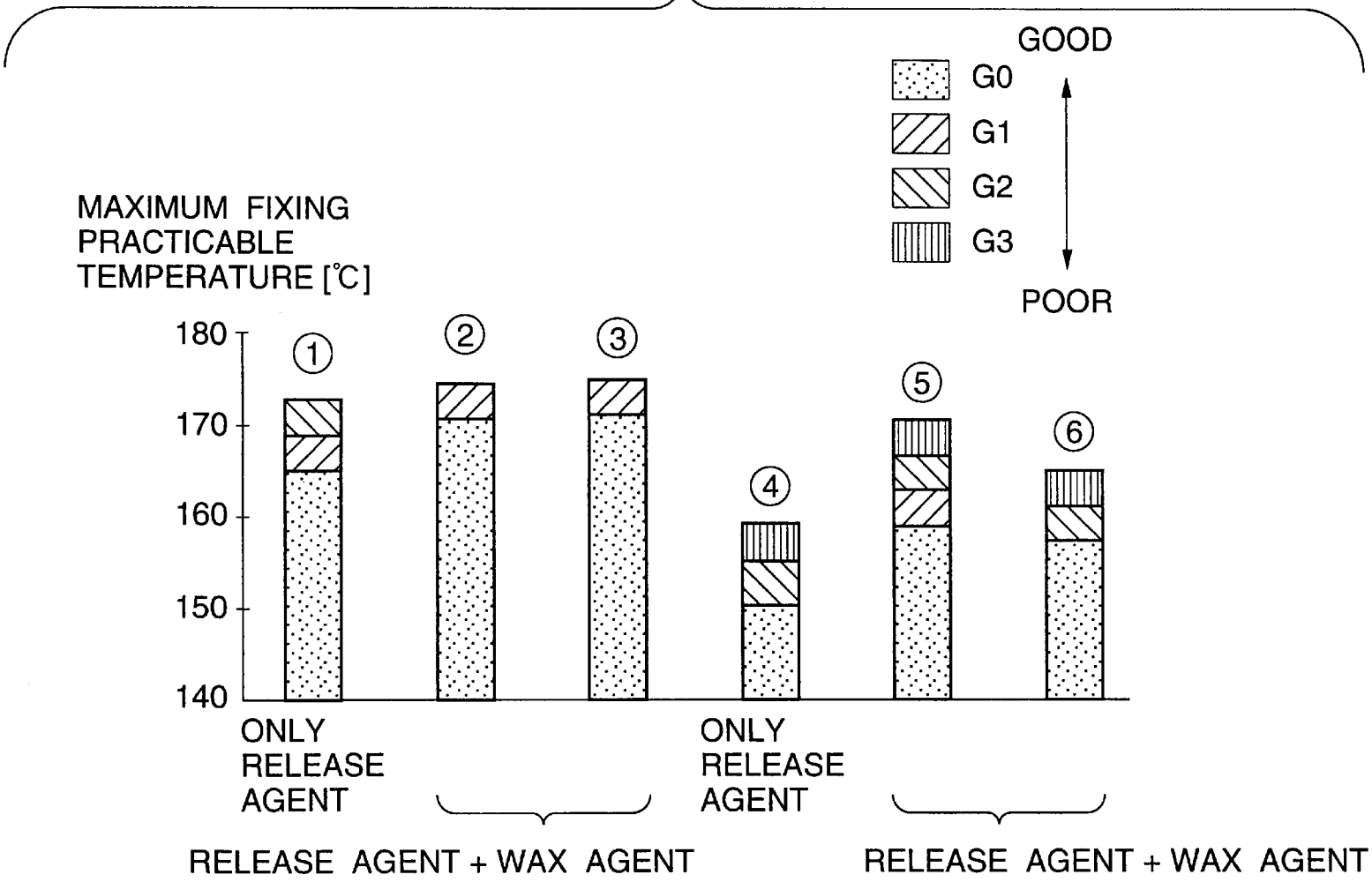
FIG. 7 is a graph showing test results for ascertaining effects of the invention.

FIG. 7 is a graph showing test results for ascertaining the effects of the present invention. This graph shows comparison between a conventional fixing device (prior art) which supplies only the release agent to the fixing rotating body 1, and a fixing device of the present invention for supplying the release agent and the wax agent, with respect to an offset preventing property at the time when the devices are new and at the time when a hundred thousand images have been formed. Reference numerals [i] and [iv] in FIG. 7 indicate the maximum fixing possible temperature of the conventional fixing device at the time when the device is new and at the time when a hundred thousand images have been formed. The maximum fixing possible temperature has such a meaning that as this temperature becomes high, the offset becomes hard to occur. The patterns of a bar graph indicate the degree of image defects (local unevenness in gloss, etc.) due to the offset. The reference character G0 indicates that there is no image defect, and G0 to G3 indicate that the image defects become poor from G0 to G3. Similarly, reference numerals [ii] and [v] indicate the offset preventing property of the fixing device (lot 1) of the present invention at the time when the device is new and at the time when a hundred thousand images have been formed, and reference numerals [iii] and [vi] indicate the offset preventing property of the fixing device (lot 2) of the present invention at the time when the device is new and at the time when a hundred thousand images have been formed. As is apparent from this graph, it is ascertained that in both the lot 1 and the lot 2, the offset at both the time when the device is new and the time when a hundred thousand images have been formed is hard to occur as compared with the conventional fixing device.

Incidentally, in the prior art and the lots 1 and 2, except application of the wax agent, the same fixing devices were used and the kind and the amount of the release agent used were also made the same. That is, amine denatured silicone oil was used as the release agent, the oil rate was made 2 $\mu$l for one recording sheet of an A4 size (single surface), hydroxystearic acid was used as wax in the wax agent, and a test was carried out with the fixing device of such a mode that the heated wax agent was previously filled in the donor roll 33 of the release agent application means 3.

As described above, according to the present invention, it is possible to provide a fixing device of an image forming apparatus in which a high quality image can be obtained through a small amount of release agent and the toner offset can be prevented for a long period of time without fail. Thus, the life of the fixing device can be extended.

What is claimed is:

1. A fixing device of an image forming apparatus, comprising:

a pair of fixing rotating bodies being brought into press contact with each other;

wax agent application means for applying a wax agent onto a surface of at least one of the fixing rotating bodies, the wax agent application means including a web member coated with the wax agent; and release agent application means for applying a release agent onto the surface of the at least one of the fixing rotating bodies, the release agent application means being provided at a downstream side of the wax agent application means in a process direction.

2. The fixing device of an image forming apparatus as claimed in claim 1, wherein the wax agent consists of a wax agent having high affinity to both a surface material of the at least one of the fixing rotating bodies and the release agent.

3. The fixing device of an image forming apparatus as claimed in claim 2, wherein the wax agent has a melting point of from 40° to 130° C.

4. The fixing device of an image forming apparatus as claimed in claim 1, wherein a ratio of the wax agent in the wax agent and the release agent held on the surface of the at least one of the fixing rotating bodies after application of the release agent is from 0.1 wt % to 20 wt %.

5. A method of holding a wax agent to the wax agent application means as claimed in claim 4, comprising the steps of:

immersing the wax agent application means in a container containing the wax agent; and taking out the wax agent application means and wiping off the excessive wax agent while the wax agent application means is rotated.

6. The method of holding a wax agent to the wax agent application means as claimed in claim 4, comprising the steps of:

applying the wax agent onto the wax agent application means; and spreading the wax agent onto the wax agent application means by a blade or web while the wax agent application means is rotated.

7. The fixing device of an image forming apparatus as claimed in claim 1, wherein the wax agent application means includes the web member coated with band-like wax agents with an interval between them.

8. The fixing device of an image forming apparatus as claimed in claim 7, wherein an interval of band-like wax agents at a rear side of the web member of the wax agent application means is narrower than that at a front side of the web member.

9. The fixing device of an image forming apparatus as claimed in claim 1, wherein the wax agent application means applies the wax agent depending on the deterioration of the surface of the at least one of the fixing rotating bodies.

10. A fixing device of an image forming apparatus, comprising:

a pair of fixing rotating bodies being brought into press contact with each other;

wax agent application means for applying a wax agent onto a surface of at least one of the fixing rotating bodies; and release agent application means for applying a release agent onto the surface of the at least one of the fixing rotating bodies, the release agent application means being provided at a downstream side of the wax agent application means in a process direction, wherein the wax agent application means includes:

a shaft;

a wax agent holding layer provided on an outside diameter portion of the shaft; and a wax agent regulating layer provided on the outside diameter portion of the wax agent holding layer.

11. A fixing device of an image forming apparatus, comprising:

a pair of fixing rotating bodies being brought into press contact with each other; and mixture application means for applying a mixture of a wax agent and release agent onto a surface of at least one of the fixing rotating bodies, the mixture application means including a web member coated with the mixture.

12. A fixing device of an image forming apparatus as claimed in claim 11, wherein the wax agent consists of a wax agent having a high affinity to both a surface material of the at least one of the fixing rotating bodies and the release agent.

13. The fixing device of an image forming apparatus as claimed in claim 11, wherein a ratio of the wax agent in the mixture of the wax agent and the release agent is 1 wt % or less.

* * * * *